United States Patent [19]

Sivachenko et al.

[11] 4,129,917

[45] Dec. 19, 1978

[54] BRIDGE STRUCTURE

[75] Inventors: Eugene W. Sivachenko, 6471 Riverside Dr., Redding, Calif. 96001; Firoze H. Broacha, Lakewood, Colo.

[73] Assignee: Eugene W. Sivachenko, Redding, Calif.

[21] Appl. No.: 890,439

[22] Filed: Mar. 27, 1978

[51] Int. Cl.[2] ..... E01D 19/12

[52] U.S. Cl. ..... 14/73; 14/17; 14/6; 52/334; 52/335; 52/731; 52/782

[58] Field of Search ..... 14/73, 74, 1, 6, 2, 14/17; 52/334, 335, 336, 378, 618, 625, 629, 630, 731

[56] References Cited

U.S. PATENT DOCUMENTS

| | | | |
|---|---|---|---|
| 523,143 | 7/1894 | Francis | 52/336 |
| 1,546,118 | 7/1925 | Chubbuck | 52/336 |
| 2,017,832 | 10/1935 | Hovey | 14/73 |
| 3,027,687 | 4/1962 | Baroni | 14/73 X |
| 3,066,771 | 12/1962 | Wolchuk | 14/73 X |
| 3,103,025 | 9/1963 | Gassner | 14/73 X |
| 3,156,070 | 11/1964 | Mesnager | 52/629 X |
| 3,181,187 | 5/1965 | Kahn | 14/73 |
| 3,397,497 | 8/1968 | Shea | 52/335 |
| 3,812,636 | 5/1974 | Albrecht | 52/334 |
| 3,849,237 | 11/1974 | Zetlin | 14/73 X |

*Primary Examiner*—Nile C. Byers, Jr.
*Attorney, Agent, or Firm*—Townsend and Townsend

[57] ABSTRACT

A bridge which has a bridge deck constructed of corrugated checkered metal plate and which is supported by a plurality of side-by-side box beams carried by spaced apart beam supports. The box beams have upright sides which are connected to upper and lower chord plates all of which are constructed of corrugated plate having corrugations which run parallel to the length of the box beams and which have a large, e.g. 16 × 6 inch corrugation pitch and depth. The chord plates and sides are bolted together at spaced apart intervals. Thin walled shear plates are placed against the box beam sides and bolted to the corrugation troughs of the sides and they carry vertically acting shear loads while their connection to the box beams prevents them from buckling. A concrete layer is poured on top of the bridge deck so as to form a mechanical interlock between the concrete and the deck to thereby structurally integrate the concrete layer with the remainder of the bridge. A longitudinal camber can be incorporated in the box beam.

53 Claims, 9 Drawing Figures

BRIDGE STRUCTURE

BACKGROUND OF THE INVENTION

At the present, there are in the U.S. alone upwards of 105,000 inadequate bridges. A majority of them are functionally obsolete while a lesser number of them are structurally deficient. The latter are defined as bridges which had to be restricted to light vehicles only or closed, while the former are identified as bridges which can no longer safely service the system of which they are an integral part. The replacement cost for these bridges is in the tens of billions of dollars. A majority of these bridges are relatively short span bridges, say bridges having a length of 30 to about 100 feet. Applicants have recently invented a bridge system ideally suited for building such bridges with relatively low production and erection costs. Although this system is expected to greatly facilitate the replacement of these shorter bridges, it is relatively less well suited for incorporation in long span bridges, say bridges which have a clear span of 100 feet or more up to several hundred feet. Generally, such bridges are constructed as continuous, cantilivered, suspension, or arch bridges.

Whatever the particular construction of the bridge, the load or traffic carrying surface is intermittently supported over its length, either by piers or with suspension cables. The bridge deck and more specifically the support structure for the deck must have sufficient strength and rigidity to carry the load between the support points.

The probably most common manner of supporting the bridge deck between the above discussed support points is by providing suitable beams or girders which carry the deck. For relatively short spans (between support points) extruded steel profiles may suffice. For longer spans, however, it is necessary to fabricate structures to achieve the necessary strength and rigidity without requiring excessive amounts of materials. Here, one of the most common forms of construction is to provide a supporting steel framework, usually made up of plate, angle, channel, etc. which are welded or riveted together. For relatively long spans and/or for heavy loads an efficient support structure are so-called box beams which have a relatively high strength to weight ratio.

Conventional box beams are made of flat plates that are typically welded to each other. Inspite of their advantages over prior art forms of long span, high strength and rigidly fabricated support beams, they remain relatively heavy. Flat plate in many instances is an inefficient geometric configuration for carrying a variety of loads, particularly shear and bending loads. The latter and in particular, the shear stresses that must be carried by the box beam, which typically is several feet in height, may result in a buckling of the vertical beam wall unless it is supported at intermediate points over its height. According to the prior art, this is accomplished by securing, typically welding stiffeners which have substantial depths (perpendicular to the flat sheets of which the box beams are constructed) such as angle irons, channels and the like to either the inside, the outside, or both of the walls. Since at least the upper chord plate of the box beam is subjected to significant compression forces, which may again cause the buckling of the plate, it too must be stiffened in a manner analogous to that of the side walls of the beam.

The stiffening members attached to the flat walls of prior art box beams are normally welded thereto, frequently over their entire length to avoid the formation of pockets which may collect moisture and which may result in an accelerated corrosion of the underlying metal. The great deal of welding that is required is not only time consuming and, therefore, expensive, it normally results in locked in stresses or outright damage to the base metal adjacent the welds. Further, stresses due to strinkage when the weld metal cools may lead to hairline cracks which may not form until some time after the beam has been assembled and installed. Needless to say, such cracks are difficult and, therefore, expensive to detect and, more seriously, if they go undetected they pose a serious danger to life and property. At the very least, once detected they may require expensive corrective work in the field.

U.S. Pat. No. 3,181,187 is illustrative of a bridge construction which employs longitudinally extending box beams for supporting the bridge deck and road surface.

SUMMARY OF THE INVENTION

The present invention is particularly adapted for long span bridges. Generally speaking, it provides a box beam support for the bridge deck which normally is disposed longitudinal, i.e. parallel to the road bed and the length of the bridge. For certain applications, notably suspension bridges, the box beams may also extend perpendicular to the road bed. In the latter case, the length of a box beam coincides rougly with the width of the bridge.

The box beam itself is constructed of relatively thin walled corrugated plate in which the corrugations run parallel to the length of the beam. Preferably, the corrugations have a trapezoidal cross-section and a pitch and a depth of at least about 16 inches and 5 inches, respectively. In this manner, the corrugated sheets can be constructed from standard flat sheet stock, such as 48 or 52 inch wide stock, and can be provided with at least two full corrugations. These corrugations have the further advantage that they enable the fabrication of the plate from flat sheet stock which may have a yield stress of up to 50,000 psi or more without overstressing the material while it is being corrugated in conventional corrugating equipment.

Furthermore, the corrugated sections are preferably constructed of copper bearing steel, such as is marketed under the trade designation COR-TEN by the U.S. Steel Corportion of Pittsburgh, Pa. Briefly, upon exposure to the atmosphere, these materials' surface oxidize and form a self-protective coating, assuring that even prolonged exposure to the atmosphere does not adversely affect the structural integrity of the underlying metal. Accordingly, by constructing the box beam components of such corrosion resistant materials, thinner cross-section materials can be employed which, in turn, are more readily worked and enable one, for example, to construct the box beam members from flat sheet metal stock of a thickness of as little as 3/16 to ¼ inch since the heretofore necessary "safety thickness" to protect against undetected corrosion can be greatly reduced or eliminated. The thinner cross-section, however, allows one to form relatively inexpensive metal such as flat sheet metal stock, into more intricate, stronger shapes, such as corrugated plate at relatively low cost. Equally important, by constructing the box beam in the above discussed manner and of such corrosion resisting material, the need for the initial application of a protective coating and for subsequent maintenance are eliminated, thus enhancing the economies provided by the present invention.

Structurally, a bridge constructed in accordance with the present invention comprises a bridge deck and at least one and normally a plurality of side-by-side box beams. Each beam has first and second, elongate, generally upright walls joined by, e.g. bolted to upper and lower box beam chord plates. The walls and the chord plates are constructed of the above discussed corrugated plate and the corrugations are arranged so that they run parallel to the length of the beam.

Attached to the side walls are shear plates. The shear plates are flat, generally rectangular and relatively thin plates which carry the shear (vertical) load to which the beam is subjected and thus relieve the corrugated side walls of the beam of such loads. To prevent the buckling of the thin shear plate under the normally substantial shear loads it is secured, e.g. bolted to at least some and preferably to all corrugation troughs of the box beam side walls which protrude towards the shear plate. The bolt locations are longitudinally equally distributed over the common length of the shear plate and the side wall. Thus, the connections between the two are substantially evenly distributed over the area of the shear plate, that is over its lateral and longitudinal extent. The shear plate is continuous, extends over substantially the full length of the side wall, and can be applied to the exterior or the interior thereof. In the former case, the shear plates can be employed to achieve desired aesthetic effects and, for example, to give the box beam the appearance of a conventional box beam constructed of flat plate.

In a preferred embodiment, the lateral edge portions of the shear plate are bent 90° to define flanges which are secured to lateral sides of the chord plates. To adequately rigidify the box beam and the overall bridge against horizontally acting (wind) forces vertically oriented stiffeners are intermittently secured to the side walls, preferably their inside. The stiffeners may be single corrugation profiles or channels which are preferably bolted the side wall with high strength, corrosion resistant bolts.

As a result of this construction, no or very few welds are required for assemblying the box beam of the present invention. This saves significant labor and, therefore, cost. More importantly, the vertical and horizontal box beam members are all constructed of relatively lightweight corrugated plate, yet they are extremely rigid longitudinally to absorb the large bending moments encountered by bridges while the simple, relatively inexpensive shear plates bolted to the box beam side walls not only take the shear loads but also enable one to achieve desired architectural effects.

Further, a bridge constructed in accordance with the present invention is provided with a bridge deck. For some applications, the upper chord plates of the box beams may be employed to simultaneously define at least a portion of the deck. Normally, however, the deck is constructed separately of the chord plates and is also corrugated with its corrugations running transversely, e.g. perpendicular to the corrugations of the box beam members. The bridge deck is corrugated from what is customarily referred to as "checkered plate" which may have any desired pattern, such as a diamond pattern and which is defined by intermittent protrusions on one side of the plate which can extend up to about $\frac{1}{8}$ inch above the remainder of the plate. Such plate is in wide use as flooring and the like. By constructing the deck of such corrugated plate a subsequently poured structural layer becomes mechanically locked to the deck. This, in turn, structurally integrates the concrete with the deck and, by correspondingly securing the deck to the box beams renders the overall bridge a unitary structure in which all components perform a structural function rather than constituting deadweight as was so often the case in the past.

Also disclosed are a variety of different embodiments all of which employ the above-discussed main features of the present invention to a greater or lesser extent. For example, in a presently preferred embodiment, the box beams are unitary, that is each box beam has two side walls and the associated horizontal chord plates. Furthermore, the box beams are constructed so that they can be prefabricated at a plant and then transported to the erection site. Accordingly, these beams preferably have at least one transverse dimension, e.g. a width which does not exceed acceptable rail and/or highway width limits, preferably which does not exceed about 8 feet.

In an alternative embodiment, the box beams may be directly joined so that each pair of adjoining beams has a common vertical beam wall. Moreover, for aesthetic or other reasons, the outermost side walls of the box beams, or the side walls of a single box beam, may be tapered upwardly and outwardly so as to create special architectural effects or, particularly, for single beam constructions, so as to increase the usable deck width.

In a further embodiment of the invention a layer of concrete is applied to the exterior of the corrugated side walls and/or the underside of the lower chord plate. When applied to the side walls the concrete layer functions as the shear plate. In addition, the concrete layer gives the box beam the appearance of a concrete structure which may sometimes be desirable for architectural reasons. Further, the concrete layer constitutes a highly efficient corrosion protection for the metal of the underlying box beam.

As will be apparent from the preceding discussion, the present invention provides a box beam structure particularly adapted for supporting bridge decks over relatively long spans which result in significant material and labor savings due to the structurally highly efficient profile given to each member of the beam and the simple manufacturing and assembly of the beam components. Moreover, by employing the above discussed corrosion resistant materials, the heretofore common protective coatings and concern with an undue loss of structural metal to corrosion are substantially eliminated, thus making it possible to employ the structurally advantageous design, particularly the large pitch and depth corrugations for the box beam members while reducing manufacturing and maintenance costs. Still further, in view of the substantial reduction in the overall weight of the box beam, the erection of the bridge is correspondingly simplified, leading to further cost savings. The overall savings provided by the present invention should greatly facilitate the task of replenishing the above-discussed huge bridge deficit with which we are presently confronted.

Lastly, the present invention provides means for incorporating in the box beam a longitudinal camber of at least the upper chord plate and, therewith the bridge deck carried thereon. The camber is formed by rolling into the corrugated side walls of the box beam adjacent the upper, longitudinal edge of the side wall a trough which is deepest adjacent the ends of the side wall and which becomes successively shallower towards the center of the side wall until the trough disappears at the center. In this manner, the uppermost edge of the side wall is drawn downwardly from the center of the side wall towards the ends to give it a convex shape. Both the upper chord plate and the bridge deck carried thereon are given a correspondingly convex shape.

Although, for the proper use of the bridge it is not necessary, for aesthetic reasons it might be desirable to include a corresponding camber in the lower longitudinal edge of the side walls and the lower chord plate. This is done in the same manner by reversing the depth of the trough so that it is deepest at the center of the box beam and disappears at the ends thereof. The lower side wall edge and chord plate are thus given a concave shape.

It should be noted that the camber is incorporated in the box beam of the present invention without requiring a corresponding curvature of the longitudinally extending corrugations. The corrugations remain straight; only the longitudinal edges of the corrugated side walls are convexly and concavely cambered. The corrugated side walls can, therefore, be corrugated on standard equipment. Accordingly, except for the relatively minor cost of rolling the camber troughs into the side walls, the provision of a camber does not add to the overall cost of the bridge.

DESCRIPTION OF THE PREFERRED EMBODIMENTS

Figure 1:
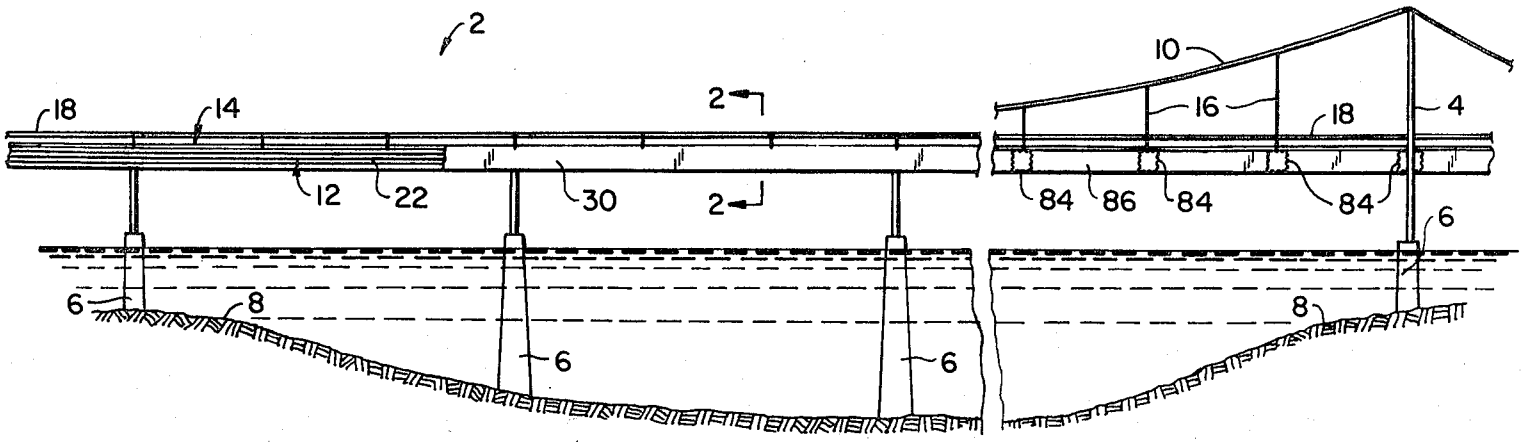
FIG. 1 is a schematic, side elevational view, with parts broken away, illustrating a bridge constructed in accordance with the present invention with the lefthand and the righthand portions of the figure showing different embodiments.

Referring first to the lefthand half of FIG. 1, a continuous bridge 2 generally comprises piers 6 sunk into the ground 8, which intermittently support a main, longitudinally extending bridge truss 12. A road bed 14 is carried by the truss. Conventional guard rails 18 form lateral barriers for the roadway.

Figure 2:
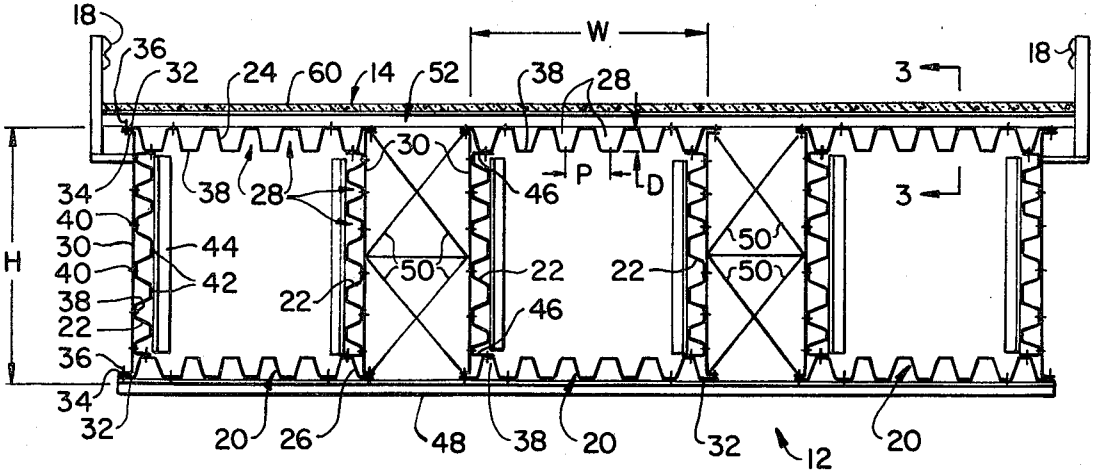
FIG. 2 is an enlarged, elevational view of the bridge shown in the lefthand side of FIG. 1 and is taken on line 2—2 of FIG. 1.
Figure 3:
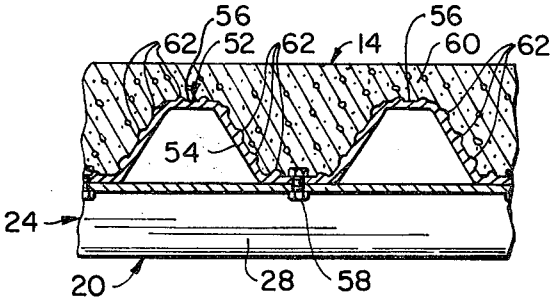
FIG. 3 is a fragmentary, enlarged detail of the construction of the bridge deck and is taken on line 3—3 of FIG. 2.

Referring now to FIGS. 1–3, in one embodiment of the invention, truss 12 is defined by a plurality, e.g. three spaced apart, longitudinally (in the direction of the bridge length) running box beams 20 each of which is defined by a pair of generally upright box beam side walls 22 and spaced apart upper and lower box beam chord plates 24, 26, respectively, which are secured to the side walls in the manner further described below.

As earlier discussed, each of the side walls and the chord plates is constructed of corrugated plate which has corrugations 28 of a generally trapezoidal cross-section and the relatively large corrugation pitch "P" and corrugation depth "D". The corrugations run parallel to the longitudinal axes of the box beams. Further, the box beam may have a generally square cross-section or its height "H" or width "W" may be relatively larger or shorter to give the box beam a rectangular cross-section. For purposes of this application, however, the term "square cross-section" relative to the box beam includes such rectangular cross-sections. In any event, it is preferred that the cross-section of the beam is chosen so that at least one of its height or width does not exceed 8 feet to enable its fabrication at a plant and subsequent shipment to the erection site via conventional transportion means such as railroad cars or trucks.

As is well-known, under normal loading the box beam side walls are stressed by bending moments to which truss 12 as a whole and the box beams 20 individually are subjected and by vertically acting shear forces. Thus, the shear forces act perpendicular to corrugations 28. Since corrugated plate as such cannot be subjected to significant forces which act transversely to the corrugations a shear plate 30 is placed against each box beam side wall. The shear plate is relatively thin, say in the order of between about ⅛ to 5/16 inch, and its ends are preferably bent 90° to define flanges 34 which are dimensioned so that they fit between lateral edge portions 32 of the upper and lower chord plates 24, 26. The flanges are secured to the chord plate edge portions with bolts 36 or the like.

Intermediate sections of the shear plate are intermittently secured to corrugation troughs 38 of side walls 22 with a plurality of bolts 40 which are evenly distributed over the width and length of the shear plate.

The multiple connections between the shear plate and the corrugation troughs rigidify the former and prevent its buckling under the shear forces so as to effectively rigidify the side wall in a vertical direction, that is in the direction perpendicular to corrugations 28. The shear plate 30 extends over substantially the full length of the corresponding box beam so that the box beam, from the exterior, appears as if it were constructed from flat plate as was conventional in the past.

The box beam is further stiffened or rigidified against laterally acting forces such as wind forces by affixing to the inside of the corrugated box beam side walls intermittently placed, vertically oriented stiffening members 44 which are bolted to corrugation peaks 42 contacted by them. In a typical embodiment of the invention the stiffening members may comprise slightly more than one-half corrugation, so as to define a channel and they are attached to the box beam side walls at about 20 foot intervals.

The actual assembly of a box beam 20 constructed in accordance with the present invention is very simple. Initially flat plate stock is corrugated. To the extent that the plate stock is of an insufficient width to corrugate the full beam side wall 22 or chord plates 24, 26 from a single plate, two or more plates may be independently corrugated and then longitudinally welded together with high speed, conventional automatic welding equipment (not separately shown) so as to obtain the desired corrugated plate width. Alternatively, the plates may be bolted, riveted, etc. together. One of the side walls and the chord plates, say the side walls (as shown in FIG. 2) are formed so that they have an outermost flange 46 which is perpendicular to the plane of the side wall. The flanges 46 are spaced so that they fit flush against adjacent corrugation troughs 38 of the upper and lower chord plates 24, 26. Bolts rigidly interconnect the side wall flanges 46 with the chord plates as is illustrated in FIG. 2 to form a unitary, high strength but lightweight box beam 20. Next, the shear plates 30 and the stiffening channels 44 are bolted to the side walls in the earlier described manner to complete the beam and ready it for shipment to the erection site. The box beam must, of course, be constructed of much shorter sections (usually having a length of no more than between about 40 to 80 feet in length) than its overall length. At the erection site, the beams are hoisted into position and assembled end to end by overlapping end portions of the side walls and the chord plates and bolting them together.

To effect the proper nesting of the overlapping corrugations, it is normally necessary to take into consideration the material thickness of the corrugated plate. In accordance with one embodiment of the invention, the corrugations are formed so that they have alternatingly differing base widths in which the difference is approximately one plate thickness so that the overlapping corrugation peaks and troughs can properly nest. As a practical approximation, the base widths may, for example, differ by 3/16 inch which can accommodate the nesting of corrugated plates having material thicknesses of up to about ¼ inch. This difference in the base width may be corrugated into the plates so that it extends over their full lengths or it may be subsequently formed in the end portions of the plates only, e.g. in a suitably constructed press or similar device.

Once hoisted into place, tie bars, say U-shaped, flanged channel members 48 (again defined by slightly more than one-half a corrugation, for example) are placed against the underside of lower chord plates 26 at spaced apart intervals (matching the location of stiffening channels 44) and secured, e.g. bolted thereto to rigidly interconnect the box beams 20. Further, bracing such as diagonal angle irons 50 are placed in the space between adjacent box beams (at locations which also match the location of stiffening channels 44) to laterally rigidify the truss 12. In a preferred embodiment, the longitudinal spacing between bracings is approximately 20 feet. Also, the truss is conventionally secured to piers 6 so as to support it at spaced apart intervals. This aspect of the bridge forms no part of the present invention; it is therefore, not further described herein.

A bridge deck 52 can now be placed on top of truss 12. Preferably, the bridge deck is constructed of corrugated plate sections 54 having corrugations 56 (FIG. 3) which run transversely, e.g. perpendicular to the corrugations of the box beams. Bolts 58 rigidly secure the deck to the upper chord plates. Lastly, road bed 14 is formed by placing a suitable road bed defining material on top of the bridge deck.

In the preferred embodiment, the road bed comprises a layer 60 of structural concrete. To render the concrete load bearing and to structurally integrate it with the bridge deck and, therewith, with truss 12 the corrugated plate sections 54 are constructed of so-called checkered plate, arranged for example in a diamond pattern as is conventional so that raised protrusions 62 face upwardly (see FIG. 3) and are are uniformly distributed over the bridge deck. These protrusions, which typically can extend upwardly from a remainder of the plate by up to ⅛ inch or more form a uniform, i.e. evenly distributed mechanical interlock between the structural concrete layer 60 and the bridge deck. Thus, instead of comprising deadweight the concrete layer becomes an integral, structurally useful component of the overall bridge.

Referring briefly to the righthand half of FIG. 1, the box beams of the present invention may also be employed in a suspension bridge.

As is conventional, such a bridge comprises upright towers 4 carried by piers 6 sunk into the ground 8. Laterally spaced apart suspension cables 10 are attached to the towers in a conventional manner. The longitudinally extending bridge truss 12 carries road bed 14 and is supported at longitudinally spaced apart points by box beams 84. Ends of the box beams are supported by suspenders 16 which depend from suspension cables 10. The box beams 84 extend over the width of the bridge and their ends are conventionally secured to the suspenders. In such an instance, the longitudinally extending box beams of the truss 12 have a length about equal to the spacing between adjoining suspenders 16. The ends of box beams 86 are then suitably secured to the transverse box beams 84.

Figure 4:
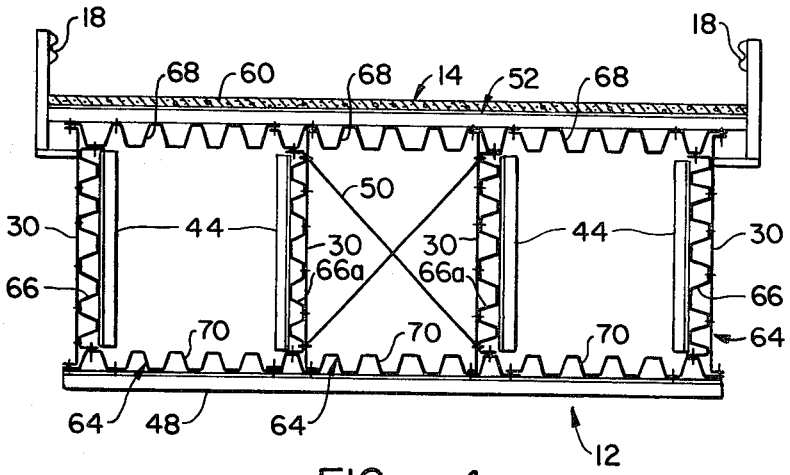
FIG. 4 is an elevational view, in section, similar to FIG. 2 but shows another embodiment of the invention.

Referring now to FIGS. 1 and 4, in an alternative embodiment of the invention, bridge truss 12 is again constructed of a plurality, e.g. three side-by-side box beams 64 which have side walls 66 and upper and lower chord plates 68 and 70, respectively. The major difference between the embodiment shown in FIG. 4 and the one previously described (FIG. 2) is that the box beams are not spaced apart but are directly adjoining and that box beam side walls 66a are common to the two adjoining box beams. Also, the upper and lower chord plates extend continuously over the width of bridge deck 52. In this manner, the lateral rigidity of the bridge is enhanced and there are material and labor savings which result from the deletion of several, e.g. two side walls (in the shown embodiment). In all other respects, the truss 12 and the box beams are as above described. Thus, the undersides of the lower chord plates 70 are tied together with tie bars 48, the side walls 66 and 66a are bolted to the upper and lower chord plates 68, 70 and bridge deck 52 is constructed and installed on top of the box beams in the earlier discussed manner. Also, the side walls of the box beams are fitted with shear plates 30 and, to the extent necessary, with stiffening channels 44 which are bolted to the side walls as previously described, and bracing 50 installed within the center box beam.

Figure 5:
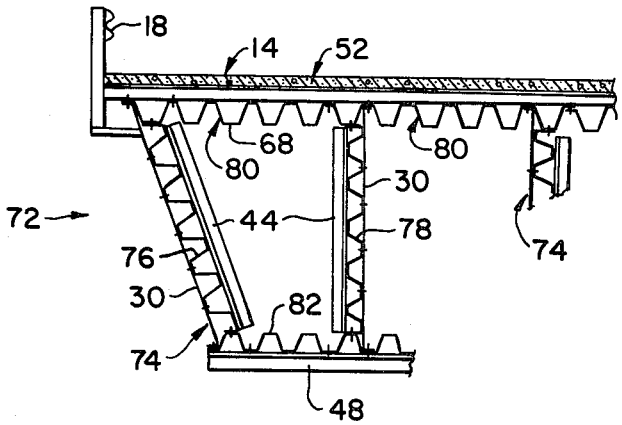
FIG. 5 is a fragmentary, elevational view, in section, similar to FIG. 2 but shows yet another embodiment of the invention.

Referring to FIGS. 1 and 5, in an alternative embodiment of the invention, a bridge truss 72 is generally constructed as above-outlined, that is of one or more (longitudinally extending) box beams 74 which carry bridge deck 52 constructed as above described. The main point of difference between this embodiment and those previously described is that the outermost box beams of truss 72 have downwardly diverging, that is downwardly and inwardly (with respect to the longitudinal center of the bridge) sloping side walls 76. In the event only one box beam is used both of its side walls would be sloped, otherwise the remaining box beam side walls 78 are vertically arranged and secured, e.g. bolted to the upper and lower chord plates 80, 82 as previously described. Again, the box beams include stiffening plates 30, stiffening channels 44, tie bars 48 and the corresponding bolts to assemble them into high strength, rigid, long length beams.

It will be apparent that the provision of a separate bridge deck 52 is not absolutely necessary. In certain applications, e.g. for relatively short spans and/or light loads, it may be advantageous to delete a separate deck and to pour the concrete for the road bed directly onto the upper surface of the upper chord plates 68 (FIG. 5). In such an event, it is, of course, preferred to construct the upper chord plates of checkered plate for the above-discussed reasons.

Figure 6:
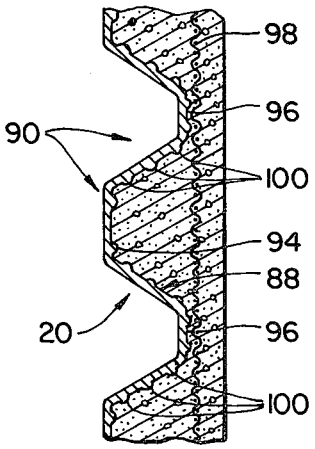
FIG. 6 is a fragmentary, elevational view, in section, and illustrates another embodiment of the invention in which a layer of concrete constitutes a shear plate.

Referring briefly to FIGS. 2 and 6, in an alternative embodiment of the invention box beam 20 is constructed in the earlier discussed manner of upright, corrugated side walls 88 having longitudinally, e.g. horizontally running corrugations 90. However, instead of applying shear plates to the exterior of the side walls (as is illustrated in FIG. 2) a layer of concrete 92 is applied to the exterior of the sidewalls. The concrete layer fills the exterior corrugation troughs 94 and extends a short distance, say one to three inches above the exterior corrugation peaks 96. A wire mesh 98 is conventionally placed over the exterior of the side walls to prevent the surface cracking of the concrete.

To enhance the adhesion of the concrete to the exterior of the side walls and to form a mechanical interlock therewith the corrugated plate is preferably constructed of the above discussed checkered plate which includes raised protrustions 100 which are uniformly distributed over the side wall.

The concrete layer not only acts as a shear plate, that is it not only absorbs the vertical load of the bridge deck and traffic carried thereon but it also changes the architectural appearance of the bridge from a steel structure to a concrete structure which may be desirable for certain applications. In such instances it may also be desirable to apply the same concrete layer to the underside of lower chord plates 26 (shown in FIG. 2 only). The concrete layer further acts as a coating for the underlying metal of the box beam and prevents its corrosion.

The concrete may be applied in any desired manner. For example, it may be poured onto the corrugated sheet while the sheet is in an essentially horizontal position on the ground and before it is hoisted into place. Alternatively, it may be advantageous to spray the concrete onto the erected side walls and lower chord plates with a process commonly referred to as "gunite".

Figure 7:
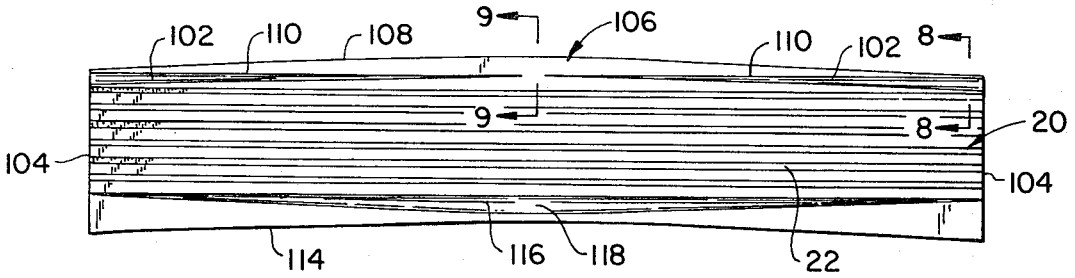
FIg. 7 is a schematic side elevational view of a box beam such as is shown in FIGS. 2, 4 and 5, and illustrates the manner in which a longitudinal camber can be incorporated in such a beam in accordance with the present invention.
Figure 8:
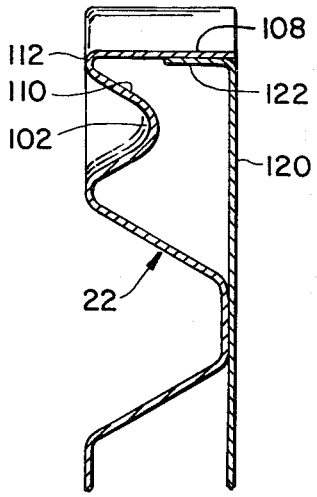
FIG. 8 is a fragmentary front elevational view illustrating the formation of the camber producing trough of the present invention and is taken on line 8—8 of FIG. 7.
Figure 9:
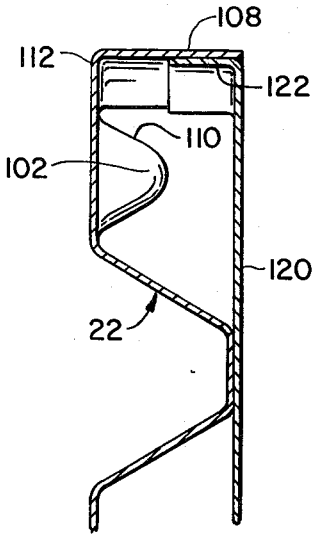
FIG. 9 is a fragmentary, front elevational view, in section, similar to FIG. 8 and is taken on line 9—9 of FIG. 7.

Referring to FIGS. 7–9, especially for bridges having long spans, it is frequently desirable to include a longtiudinal camber in the bridge so as to counteract the deflection of the bridge when subjected to its payload. In accordance with the present invention, this is accomplished by rolling into the corrugated side walls 22, a camber trough 102 which is deepest adjacent longitudinal ends 104 of box beam 20. In a preferred embodiment of the invention the camber trough has a generally V-shaped configuration and is shallowest i.e. ends adjacent a center 106 of the box beam.

The camber trough is rolled into the corrugated side wall 22 after it has been finish corrugated. The ultimate depth of the trough is chosen so as to cause the desired convex curvature of upper side wall flange 108. The cambering operation is facilitated if the camber trough is positioned as closely as possible to the upper side wall flange 108 so as to prevent the formation of stresses between the side wall flange and the trough. As a practical matter, it is best to place the camber trough so that the upper trough side 110 (at the point of greatest trough depth, i.e. adjacent beam ends 104) ends in a curved portion 112 which, in turn, terminates in upper side wall flange 108.

A similar but concave camber can be formed in the lower side wall flange 114 by providing an inverted camber trough 116 which has its deepest point 118 at the box beam center 106 and which ends adjacent beam ends 104. In all other respects, the lower camber trough is the same as upper trough 102.

For cambered box beams, the shear plate 120 is suitably formed, either by forming a connecting flange 122 which is correspondingly cambered or by flame cutting the shear plate, for example, and thereafter welding it to the upper side wall flange 108.

Since the camber is relatively small, normally it is only in the order of a few inches for several hundred feet of bridge length, it is not necessary to specially form the chord plates and/or the bridge deck (not shown in FIGS. 7–9). Upon their installation they can be readily drawn against the cambered box beam side walls with bolts, clamps and the like.

We claim:

1. A box beam for use with bridge structures and the like comprising first and second, elongate, generally upright side walls; first and second, elongate, generally horizontal upper and lower chord plates; the walls and the chord plates being constructed of corrugated plate defined by a plurality of parallel corrugations extending parallel to a longitudinal axis of the beam over the longitudinal extent of the walls and the chord plates; means attached to the side walls for carrying shear stresses applied to the side walls; and means rigidly connecting respective edge portions of the walls and of the chord plates to each other so as to form a rigid, high strength box beam therewith.

2. A box beam according to claim 1 wherein the connecting means comprises a multiplicity of high strength bolts interconnecting the respective edge portions.

3. A box beam according to claim 1 wherein the shear stress carrying means includes shear plates secured to the side walls.

4. A box beam according to claim 3 wherein the shear plates include edge portions secured to the chord plates.

5. A box beam according to claim 3 wherein the corrugated plates of the side walls define alternating corrugation peaks and corrugation troughs arranged side-by-side between lateral edges of the side walls; and including means for securing each shear plate to at least some of the corrugation troughs.

6. A box beam according to claim 5 wherein the shear plate is secured to said some corrugation troughs at a plurality of locations spaced over the lengths of such corrugation troughs.

7. A box beam according to claim 5 wherein the shear plate comprises a flat plate.

8. A box beam according to claim 1 including generally vertically oriented stiffening means attached to the side walls for rigidifying the side walls in a generally horizontal direction.

9. A box beam according to claim 1 wherein the corrugations have a corrugation pitch of at least about 16 inches and a corrugation depth of at least about 5 inches.

10. A box beam according to claim 9 wherein the corrugations of the walls have a generally trapezoidal cross-section.

11. A box girder according to claim 1 including a bridge deck defined by a corrugated deck plate having corrugations extending transversely to the corrugations of the chord plates; and means rigidly attaching the bridge deck to the upper chord plate.

12. A box beam according to claim 11 wherein the bridge deck is constructed of checkered metal plate defining a multiplicity of protrusions substantially evenly arranged over an upwardly facing surface of the deck; and a layer of concrete poured onto the bridge deck; whereby the protrusions of the checkered deck plate surface form a mechanical interlock with the concrete so that the concrete becomes a structurally integrated, load-bearing part of the box beam.

13. A box beam according to claim 1 wherein at least one of the upright walls is non-perpendicular with respect to the chord plates.

14. A box beam according to claim 1 wherein the shear stress carrying means comprises a layer of concrete applied to exterior surfaces of the side walls.

15. A box beam according to claim 14 wherein the side walls are constructed of checkered metal plate defining a multiplicity of protrusions substantially evenly arranged over exterior surfaces of the side walls, and wherein the concrete layer contacts the protrusions to form a mechanical interlock between the concrete layer and the sidewalls and to thereby structurally integrate the former with the latter.

16. A box beam according to claim 14 including a layer of concrete applied to a downwardly facing side of the lower chord plate; whereby the box beam has the appearance of a concrete box beam.

17. A box beam according to claim 1 wherein at least the edge of the side wall proximate the upper chord plate is non-parallel to the side wall corrugations.

18. A box beam according to claim 17 including a camber trough in the side wall extending in the direction of the corrugations for generating the non-parallel side wall edge, the camber trough being positioned proximate such edge and having a depth in a direction perpendicular to the side wall which varies over the length of the trough.

19. A box beam according to claim 18 wherein the trough is deepest adjacent longitudinal ends of the side wall.

20. A box beam according to claim 19 wherein the trough extends from each end of the side wall towards and terminates in the vicinity of a center of the side wall.

21. A box beam according to claim 18 including another camber trough in the side wall extending in the direction of the corrugations and located proximate a lower side wall edge, the additional trough being arranged so as to generate a longitudinally concave lower side wall edge.

22. In a long span bridge having a bridge deck, at least one box beam disposed beneath the deck and forming a structural support therefore, and means for supporting the box beam at longitudinally spaced apart points, the improvement to the deck and the box beam comprising in combination: at least one elongate box beam including substantially parallel, spaced apart upper and lower chord plates and spaced apart, generally upright sides for interconnecting the chord plates, the plates and the sides being defined by a plurality of generally parallel, side-by-side corrugations which extend over substantially the full length of the box beam; means positioning respective edge portions of the chord plates and the sides proximate to each other and rigidly interconnecting such edge portions so as to render the box beam rigid; shear plate means placed against the sides and extending over at least a substantial portion thereof; and means for rigidly securing the shear plate means to the sides at a plurality of spaced apart points distributed over the lateral and longitudinal extent of the shear plate means and the sides for enabling the shear plate means to support generally vertically acting forces while preventing a buckling of the shear plate means under such forces.

23. A bridge according to claim 22 wherein the deck is at least in part defined by the upper chord plates.

24. A bridge according to claim 23 wherein the box beam extends in a longitudinal direction of the bridge.

25. A bridge according to claim 23 wherein the box beam extends transversely to the length of the bridge.

26. A bridge according to claim 25 including a transversely arranged box beam at each support joint, and longitudinally extending box beams disposed intermediate and having ends secured to the transverse box beams.

27. A bridge according to claim 22 wherein the deck is constructed of corrugated plate, a surface of which is with a multiplicity of protrusions integrally formed with the plate means and substantially uniformly distributed thereover, said surface facing upwardly.

28. A bridge according to claim 27 including a layer of structural concrete poured on top of the bridge deck; whereby the concrete, while plastic, embeds the protrusions to form a mechanic interlock between the deck and the concrete layer and to structurally integrate the latter with the bridge.

29. A bridge according to claim 27 including means for securing the corrugated deck plate to the upper chord plate.

30. A bridge according to claim 28 wherein at least a portion of the corrugated deck plate is defined by the upper chord plate.

31. A bridge according to claim 27 wherein the corrugations of the deck are oriented substantially perpendicularly to the corrugations of the upper chord plate.

32. A bridge according to claim 22 wherein the shear plate means comprises relatively thin, flat sheets of metal placed against the box beam sides.

33. A bridge according to claim 32 wherein the sheets extend over the full width of the box beam sides.

34. A bridge according to claim 33 wherein the sheets extend over substantially the full length of the box beam sides.

35. A bridge according to claim 22 including a plurality of side-by-side box beams.

36. A bridge according to claim 34 wherein the box beams are substantially parallel to the longitudinal extent of the bridge.

37. A bridge according to claim 34 wherein adjoining box beams have a common box beam side.

38. A bridge according to claim 34 wherein adjoining box beams have independent, proximate box beam sides.

39. A bridge according to claim 38 wherein the proximate box beam sides of adjoining box beams are spaced apart, and including means defining a lateral bracing between the proximate box beam side, the bracing means being arranged at intermittent points over the length of the proximate box beam sides.

40. A bridge according to claim 34 wherein sides of the outermost box beams of the bridge which face away from a center of the bridge which face away from a center of the bridge have a vertical slope which converges downwardly towards the center of the bridge.

41. A bridge according to claim 22 wherein at least the box beams are constructed of a copper bearing, corrosion resisting steel.

42. A bridge according to claim 22 wherein the shear plate means comprises a layer of concrete applied over and covering the exterior of the side walls.

43. A bridge according to claim 22 including in the sides of each beam adjacent the upper edge portion thereof a longitudinally extending camber trough formed in the sides, having a point of greatest depth adjacent ends of the beam and a point of least depth adjacent a center of the beam so as to give the upper edge portion of the side and the upper chord plate secured thereto a longitudinally convex shape.

44. A bridge according to claim 43 including in the sides of each beam adjacent the lower edge portions thereof a longitudinally extending lower camber trough formed in each side, having a point of greatest depth proximate a center of the beam and points of least depth adjacent ends of the beam so as to give the lower edge portions of the sides and the lower chord plate secured thereto a longitudinally concave shape.

45. A long span bridge comprising in combination: a plurality of side-by-side, generally parallel box beams, the box beams having transverse dimensions at least one of which does not substantially exceed about 8 feet and being further defined by generally upright, spaced apart box beam sides and generally parallel, upper and lower chord plates, proximate edge portions of the sides and the chord plates being rigidly secured to each other, the sides and the chord plates being constructed of relatively thin walled corrugated plate made of a corrosion resisting material, corrugations of the plate having a generally trapezoidal cross-section and being arranged parallel to a longitudinal axis of the beams, the corrugations further having a pitch of at least about 16 inches and a depth of at least about 5 inches; means for rigidly securing the box beams to each other; a relatively thin shear plate attached to each box beam side, the shear plates being substantially flat and placed against the corresponding box beam sides so as to contact corrugation troughs of the side protruding towards the shear plate; means for rigidly securing the shear plates to at least some of the corrugation troughs over substantially the full height of the box beam sides to rigidify the shear plates and to prevent their buckling when subjected to vertically acting shear loads; a bridge deck constructed of corrugated plate carried by the box beams, the corrugations of the deck being oriented transversely to the corrugations of the chord plates; and a road bed placed on top of and carried by the bridge deck.

46. A bridge according to claim 45 wherein the road bed is constructed of a structurally sound material, and including means for mechanically locking said material to the deck to thereby structurally integrate the material with a remainder of the bridge.

47. A bridge according to claim 46 wherein the material comprises concrete, and wherein the means for mechanically locking is defined by the bridge deck constructed of standard checkered plate having integrally formed protrusions which are disposed on an upwardly facing surface of such plate.

48. A bridge according to claim 45 wherein the means for rigidly securing the chord plates to the sides comprises spaced apart bolt means distributed over the length of the box beam.

49. A bridge according to claim 48 wherein the chord plates and the sides of each box beam define at least four longitudinally extending flanges formed to be substantially parallel to and to snugly engage corresponding, longitudinally extending sections of the corrugations of the next adjoining box beam chord plate or side, and wherein the bolt means extends through such section and the corresponding flange.

50. A bridge according to claim 49 wherein the flanges are arranged substantially perpendicular to a remainder of the box beam chord plate or side from which they protrude.

51. A bridge according to claim 50 including bolt means for bolting together at spaced apart intervals the bridge deck and the upper box beam chord plate.

52. A bridge according to claim 51 including a tie bar means disposed on an underside of the lower chord plate, having a sufficient length to interconnect the plurality of box beams, and bolt means for rigidly securing the tie bar means to the lower chord plate.

53. A bridge according to claim 52 wherein the tie bar means has a width in a direction parallel to the box beams which is substantially less than its length, and including a plurality of spaced apart, generally parallel tie bar means secured to the underside of the lower chord plates.

* * * * *